United States Patent [19]

Brendemuehl

[11] 4,308,095

[45] Dec. 29, 1981

[54] EXTENDED LOW FREQUENCY RANGE PULSATION ATTENUATOR

[75] Inventor: Roger C. Brendemuehl, Beloit, Wis.

[73] Assignee: Beloit Corporation, Beloit, Wis.

[21] Appl. No.: 169,937

[22] Filed: Jul. 18, 1980

[51] Int. Cl.[3] ..... D21F 1/06; F16L 55/04

[52] U.S. Cl. ..... 162/253; 162/259; 162/340; 162/380; 137/207; 138/26; 138/30

[58] Field of Search ..... 162/216, 252, 253, 259, 162/336, 340, 341, 380; 181/233, 235; 137/593, 207; 138/26, 30

[56] References Cited

U.S. PATENT DOCUMENTS

| | | | |
|---|---|---|---|
| 2,766,840 | 4/1951 | Munroe | 181/50 |
| 3,063,470 | 11/1962 | Forster | 138/30 |
| 3,473,565 | 10/1969 | Blendermann | 137/593 |
| 4,030,971 | 6/1977 | Justus | 162/216 |
| 4,088,154 | 5/1978 | Patton et al. | 138/30 |
| 4,116,259 | 9/1978 | Koskimies et al. | 137/207 |
| 4,146,052 | 3/1979 | Bubick et al. | 162/340 |
| 4,179,332 | 12/1979 | Ilmoniemi et al. | 162/380 |
| 4,262,700 | 4/1981 | Moen | 162/336 |

*Primary Examiner*—S. Leon Bashore
*Assistant Examiner*—Steve Alvo
*Attorney, Agent, or Firm*—Hill, Van Santen, Steadman, Chiara & Simpson

[57] ABSTRACT

Apparatus for attenuating low frequency pressure variations in a stock suspension being fed to a paper machine. The apparatus includes a pressurized overflow chamber having an inlet which delivers a stock suspension therein and an outlet for discharging stock from the chamber. A first control means controls the pressure applied to the suspension in the overflow chamber. The chamber communicates with a sump which receives the overflow from the overflow chamber. A sensing means senses the stock pressure in the inlet conduit and a second sensing means senses the level of stock in the sump. A high pass filter receives a signal from the first sensing means and a low pass filter receives a signal from the second sensing means. A summing amplifier receives the output of the high and low pass filters. A control means receives the output of the summing amplifier and is connected to the overflow means to control operation of an overflow valve in response to the output of the summing amplifier.

8 Claims, 4 Drawing Figures

FIG. 2
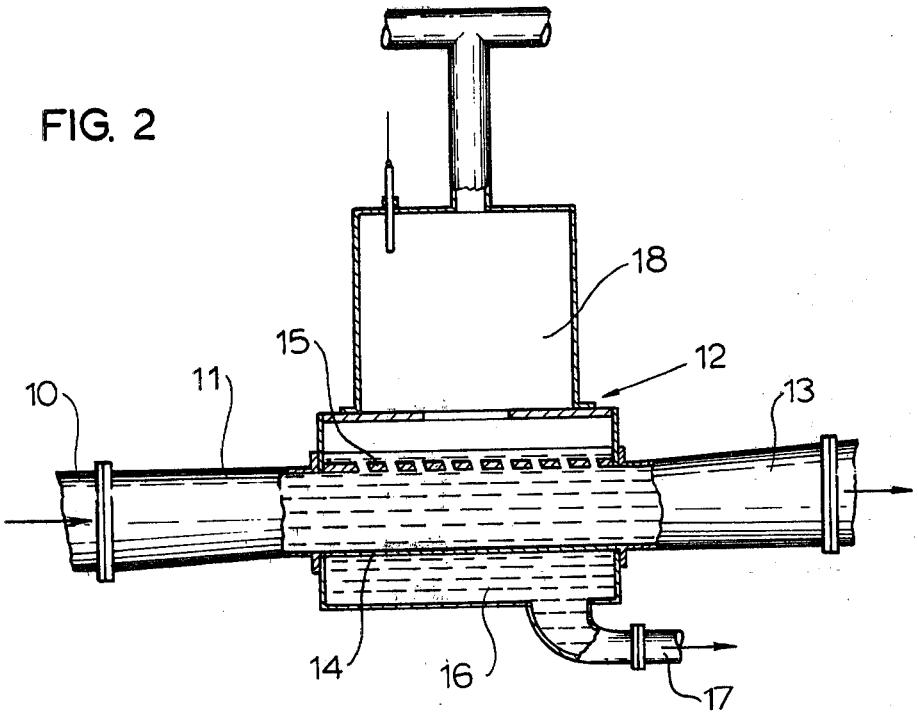
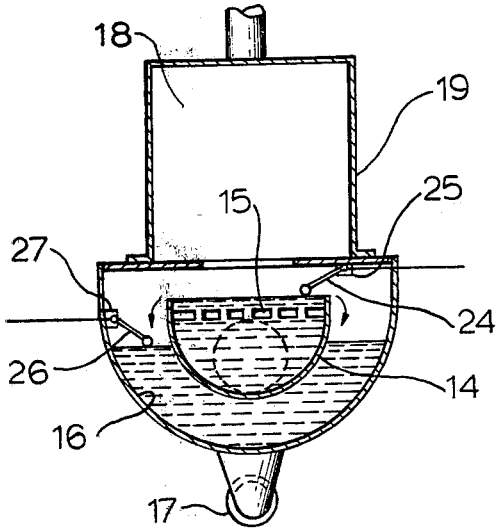
FIG. 3

EXTENDED LOW FREQUENCY RANGE PULSATION ATTENUATOR

BACKGROUND OF THE INVENTION

1. Field of the Invention

The present invention is in the field of attenuators for stock suspensions of the type used in the manufacture of paper. It makes use of sensing means which include a sensor located upstream of the attenuator which produces a signal by means of a pressure transducer and control amplifier, which signal is fed through a high pass filter so only changes in stock pressure affect it, not the steady state pressure. Means are provided to sense the stock level in an overflow sump to produce a signal which is fed through a low pass filter and is combined with the signal from the high pass filter to operate an overflow valve so as to maintain the long term level of the overflow constant.

2. Description of the Prior Art

In the operation of a supply system for feeding a paper machine, it is necessary that the fluid suspension be delivered at a steady rate. With a paper machine stock system, pulsations in the stock suspension which could be caused by pumps or screens or the like or by disturbances such as cavitation may lead to variations in the area density of the paper in the machine direction.

It is not always possible to achieve sufficient reduction in pressure pulsations by redesign in the manufacture or installation of pumps and screens. Instead, the more usual approach is to use a properly designed and properly applied attenuator or acoustic filter which reduces the magnitude of the undesired fluctuation of the flow significantly without interfering with the steady state flow.

One type of device from the prior art which has been successfully used to minimize pressure fluctuations in a paper machine headbox is described in U.S. Pat. No. 4,030,971 which is assigned to the same assignee as the present application. The mechanism described in that patent includes a flexible diaphragm which dampens pressure variations and is supported by means of air in an air chamber divided into two compartments. Air is supplied continuously at a predetermined pressure to one of the compartments, and a relief valve is positioned in the other compartment and has a port open or closed by the movement of the diaphragm so that air is bled from the compartment as the diaphragm moves toward the stock with a drop of pressure.

It has been found in practice, however, that this type of pulsation attenuator utilizing a rubber diaphragm to separate the air and the stock is limited in its low frequency response to about one Hertz. At frequencies slightly less than this frequency of minimum effective attenuation, usually about 0.5 Hertz, the tank type attenuator can actually cause an amplification of pulsations. Consequently, it is necessary for complete pulsation control to utilize the type of pulsation attenuator described in the aforementioned patent with a supplemental device for effectively attenuating at very low frequencies.

SUMMARY OF THE INVENTION

The present invention provides an attenuator which is particularly effective at very low frequencies, on the order of one Hertz or less. When the attenuator of the present invention is combined with a broadband attenuator of the type described in the aforementioned U.S. Pat. No. 4,030,971, a full range attenuation can be achieved. When used in such a combination, the diaphragm attenuator can use a smaller air chamber than normally used since it would be required to be effective at higher frequencies only.

In the system of the present invention, an air chamber is provided about a section of stock line similar to existing attenuators. However, a diaphragm is not used and stock is allowed to overflow from a through-flow pipe into a sump at the bottom of the attenuator. The overflow level is controlled by a level sensor and a level control loop which controls air pressure in the attenuator chamber by means of air supply and exhaust valves. The response time of this control loop is adjusted to be very long, being on the order of more than 10 seconds, to avoid interaction with other control loops.

The improved low frequency attenuation is achieved by proper control of stock flow from the overflow sump by means of a pair of control loops. The stock pressure upstream of the attenuator is sensed by a pressure transducer and control amplifier. This signal is fed through a high pass filter so that only fluctuations in the stock pressure will affect the overflow valve operation, i.e., the ac component, not the steady state pressure of the stock, or the dc component. The stock level in the overflow sump is also sensed by a second transducer and level control amplifier. The signal derived from this amplifier is fed through a low pass filter and serves to operate the overflow valve so as to maintain the long term level of the overflow constant. The pressure and level signals from the two amplifiers are combined in a summing amplifier and are used to operate a valve control which in turn operates the overflow valve from the sump.

The present invention achieves effective pulsation attenuation at very low frequencies by sensing the rate of change of stock pressure and draining off excess flow which otherwise would go to the slice of the headbox and cause undesirable basis weight variations. The use of the overflow chamber and the overflow sump provides a very accurate means for controlling the steady state level of stock in the tank and the overflow rate, and also provides acoustic isolation between any noise generated by the control valve and the stock line. Attenuation at frequencies higher than the response time of the control valve is achieved by providing an air pad above the level of the overflow chamber.

BRIEF DESCRIPTION OF THE DRAWINGS

The drawings illustrate several embodiments of apparatus which can be used in the practice of the present invention.

FIG. 2 is a fragmentary view partly in cross section and partly in elevation of the pulsation attenuator chamber;

FIG. 3 is a transverse cross-sectional view of the attenuator chamber shown in FIG. 2.

DESCRIPTION OF THE PREFERRED EMBODIMENTS

Figures 1, 4:
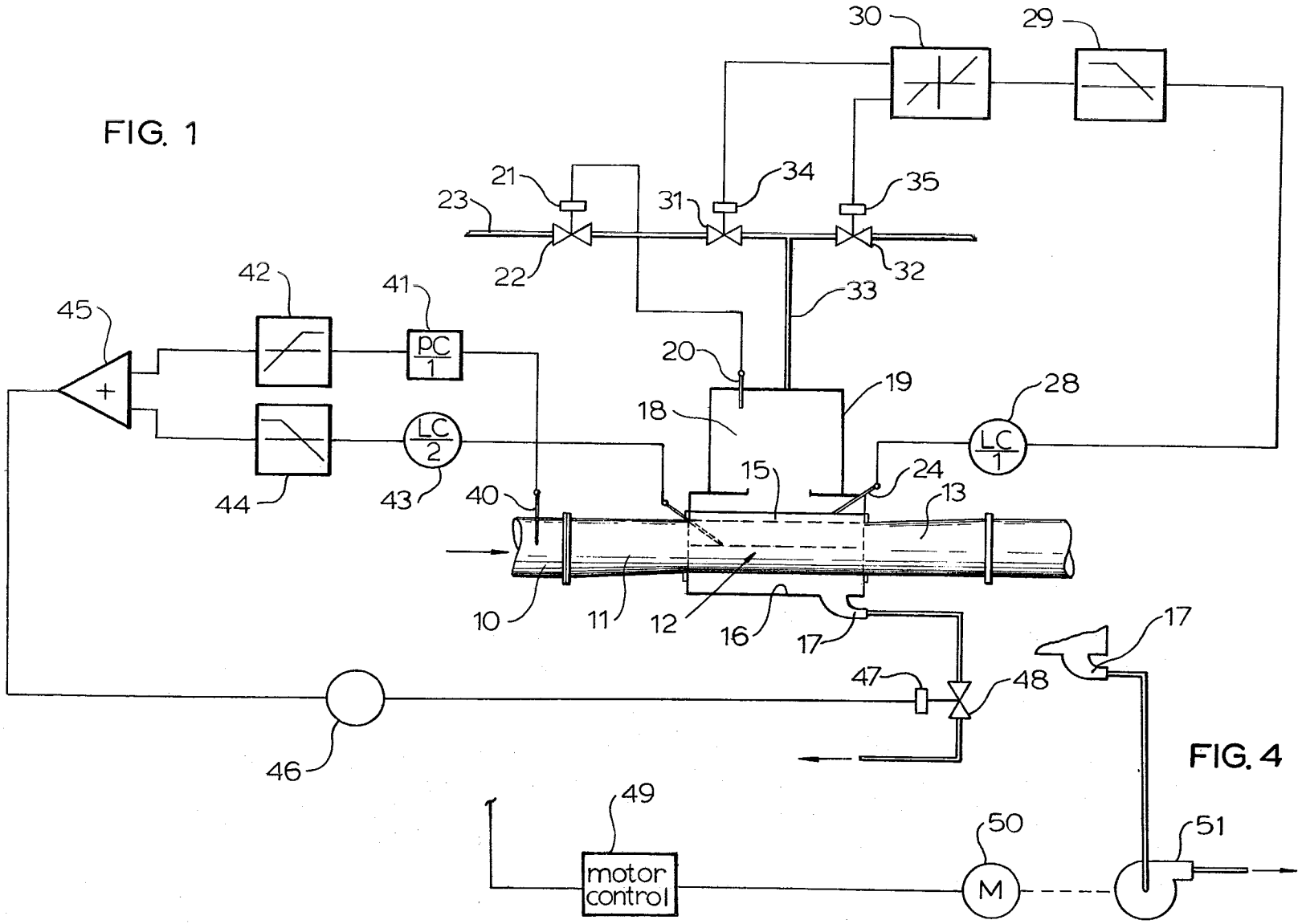
FIG. 1 is a somewhat schematic view of an overall system employing the improved attenuator of the present invention.
FIG. 4 is a fragmentary schematic view of an alternate form of the invention which can be used to replace a portion of the system shown in FIG. 1.

Turning first to FIG. 1, a stock suspension to be introduced into the headbox of a paper making machine is delivered by means of a conduit 10 into a pulsation attenuator which includes an inlet transition conduit 11, an overflow chamber generally indicated at reference numeral 12, and an outlet transition conduit 13. The overflow chamber 12 includes, as best seen in FIGS. 2 and 3, a segmented conduit 14 through which the stock suspension travels in passing through the overflow chamber. A perforated plate 15 is disposed just below the top of the conduit 14 to act as an overflow weir. As best illustrated in FIG. 2, the apertures in the orifice plate 15 are drilled at an angle to the vertical to smooth out the liquid flow above the plate 15. This provides a stable, non-turbulent liquid surface from which an accurate liquid level can be determined. The overflow, as illustrated best in FIG. 3, is collected in an overflow sump 16 and eventually passes into a drain 17.

The overflow chamber is in fluid communication with an air chamber 18 defined by means of a housing 19. A pressure sensor 20 senses the value of air pressure existing in the air chamber 18 and communicates that information to an operator 21 which controls the operation of a valve 22 located in a pressurized air inlet line 23.

Located within the chamber 12 are a pair of sensing devices, one being a level sensor 24 such as a float or the like which senses the level of the fluid suspension in the conduit 14 and actuates a potentiometer 25 or other suitable device for transforming the information into an electrical signal. Similarly, a sensing device 26 which may also be a float is positioned within the overflow sump 16 to sense the level of stock in that sump and also actuates a device 27 for relaying that information to the control circuitry about to be described.

Sensing element 24 is part of a level control loop including an overflow level control 28 which controls the air pressure in the chamber 18 by means of a low pass filter 29, an amplifier 30 provided with a dead zone, an air inlet valve 31, and an air exhaust valve 32 between which is an air supply conduit 33 feeding the chamber 18. Operators 34 and 35 controlled by signals from the amplifier 30 modulate the operation of the valves 31 and 32, respectively. Amplifier 30 has a little "electrical slack" built in so that when amplifier 30 operates both valves 34 and 35, it allows the valves to avoid constantly changing adjustment and a steady state smooth condition can be maintained. The control loop described thus far is not unique to the present invention and is used in some existing headbox designs. The response time of this control loop is set to be very long, for example, greater than 10 seconds, to avoid interaction with the other control groups of the system.

The improved low frequency attenuation in the system of the present invention is achieved by proper control of the stock flow from the overflow sump 16 by means of a pair of control loops about to be described. The stock pressure just upstream of the attenuator is sensed by means of a sensor 40 which transmits its signal to a pressure transducer and control amplifier 41. Devices of this type are commercially available from the Foxbro Corporation or Gould Company. The signal from the pressure transducer and control amplifier 41 is fed into a high pass filter 42 so that only the changes in stock pressure will affect the operation, not the steady state pressure.

The stock level in the overflow sump 16 is detected by means of the sensor 26 which feeds a signal to a transducer and level control amplifier 43. This signal is fed through a low pass filter 44. The signals from the high pass filter 42 and the low pass filter 44 are fed to a summing amplifier 45 and fed to a valve control 46. The valve control 46, in turn, controls the operation of a valve operator 47 which operates a valve 48 located in the discharge 17 of the overflow sump 16. To achieve the most rapid flow response from the overflow control valve, the valve should be mounted as close to the attenuator overflow sump 16 as possible and the discharge line from the valve should have a zero back pressure. In some instances, this requirement may not be capable of being achieved since the level of the overflow valve discharge must be above the silo or wire pit level. In such instances, the alternative approach shown in FIG. 4 could be used. In this embodiment of the invention, the valve control 46 is replaced by a motor control unit 49 and a variable speed motor 50, the latter driving a pump 51 which receives the discharge from the discharge line 17 and pumps it under positive pressure to the silo or wire pit.

The system of the present invention achieves effective pulsation attenuation at very low frequencies by sensing the rate of change of stock pressure and draining off excess flow which otherwise would go out to the slice and cause undesirable basis weight variations. The use of the overflow system and the orifice plate provides a very accurate means for controlling the steady state level of stock in the tank and the overflow rate, and also provides acoustic isolation between any noise generated by the control valve and the stock line. Attenuation of frequencies higher than the response time of the control valve are achieved by the air cushion located above the level of the overflow chamber.

It should be evident that various modifications can be made to the described embodiments without departing from the scope of the present invention.

I claim as my invention:

1. A stock supply system providing reduced low frequency pressure variations in a stock suspension being fed to a paper machine comprising:

an attenuator chamber, inlet conduit means arranged to deliver a stock suspension into said attenuator chamber, said attenuator having an air chamber which applies pressure to the stock suspension discharge means receiving the stock suspension discharged from said attenuator chamber, a control system comprising a first sensor for sensing the pressure applied to said suspension and control means for controlling the pressure applied to said suspension in said attenuator chamber, a sump receiving the overflow from said attenuator chamber, discharge means for receiving the stock suspension discharged from said sump discharge control means for controlling the discharge from said sump, second sensing means for sensing the stock pressure in said inlet conduit means upstream of said attenuation chamber, third sensing means arranged to sense the level of stock in said sump, a high pass filter receiving a signal from said second sensing means, a low pass filter receiving a signal from said third sensing means, a summing amplifier receiving the outputs of both said high pass and low pass filters, and said discharge control means receiving the output of said summing amplifier and connected to said discharge means to control operation of said discharge means in response to said output.

2. A system according to claim 1 in which:

said discharge control means includes a valve control and an overflow valve receiving the discharge from said sump.

3. A system according to claim 1 in which:

said discharge control means includes:

a motor control, a pump, and a variable speed motor connected to said motor control and arranged to drive said pump at variable speeds.

4. A system according to claim 1 in which:

said attenuator chamber includes a perforated plate through which said stock suspension flows in overflowing into said sump.

5. A system according to claim 2 in which said overflow valve is located at a position at which it discharges into substantially zero back pressure.

6. A system according to claim 1 which includes means supplying pressurized air into said attenuator chamber.

7. A system according to claim 4 which includes a segmental conduit in said attenuator chamber through which said stock flows, said perforated plate being located in the open end of said segmental conduit.

8. A system according to claim 4 in which said perforated plate has apertures therein extending at an angle to the vertical to smooth out liquid flow above said plate.

* * * * *